US008073374B2

(12) United States Patent
Halfyard et al.

(10) Patent No.: US 8,073,374 B2
(45) Date of Patent: Dec. 6, 2011

(54) FUSER OIL APPLICATOR AND CLEANER IN A SINGLE WEB CARTRIDGE SYSTEM IN DIRECT CONTACT WITH FUSER ROLL

(75) Inventors: Kurt I. Halfyard, Mississauga (CA); T. Brian McAneney, Burlington (CA); Edward Graham Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 8 days.

(21) Appl. No.: 12/714,967

(22) Filed: Mar. 1, 2010

(65) Prior Publication Data

US 2011/0211877 A1 Sep. 1, 2011

(51) Int. Cl.
*G03G 15/20* (2006.01)

(52) U.S. Cl. ..... 399/327

(58) Field of Classification Search ..... 399/327, 399/326, 325, 324
See application file for complete search history.

(56) References Cited

U.S. PATENT DOCUMENTS

| | | | | |
|---|---|---|---|---|
| 4,557,588 | A | 12/1985 | Tomosada | |
| 4,924,271 | A | 5/1990 | Brinton et al. | |
| 5,023,464 | A * | 6/1991 | Mitsuya et al. | 399/323 |
| 5,452,065 | A | 9/1995 | Bell | |
| 5,576,821 | A | 11/1996 | Rasch et al. | |
| 6,032,016 | A * | 2/2000 | Morigami et al. | 399/325 |
| 6,505,832 | B2 | 1/2003 | Moore et al. | |
| 6,743,561 | B2 | 6/2004 | Hecks et al. | |
| 2005/0110854 | A1 | 5/2005 | Roof et al. | |
| 2009/0285608 | A1 | 11/2009 | Ruiz et al. | |

FOREIGN PATENT DOCUMENTS

JP 11065344 A * 3/1999

* cited by examiner

*Primary Examiner* — Quana M Grainger
(74) *Attorney, Agent, or Firm* — Ronald E. Prass, Jr.; Prass LLP

(57) ABSTRACT

According to aspects of the embodiments there is provided a cassette cleaning web having an agent metering tube that can apply oil via a drip pipe to a web as it enters a nip within the fusing surface. Dispensing the oil as it enters the nip increases the transportation and the holding capacity of the web. The cassette cleaning web can reduce the oil-on-copy to less than 3 mg/copy and more specifically to less than 1 mg/copy which would allow for adequate post finishing applications while still using amino functionalized fuser oil in the fuser subsystem. The cassette cleaning web reduces the contamination of the oil-sump because used web materials are wound up and oil or contaminate materials like wax, toner are retained in the spent web cartridge. This invention enables reduced oil-on-copy, eliminates the bulky and expensive release agent management system, and also provides a direct cleaning to the surface of the fuser roll.

20 Claims, 6 Drawing Sheets

FUSER OIL APPLICATOR AND CLEANER IN A SINGLE WEB CARTRIDGE SYSTEM IN DIRECT CONTACT WITH FUSER ROLL

BACKGROUND

This disclosure relates in general to an image forming apparatus comprising a fuser cleaner web for cleaning a surface like a fuser roll, and more particularly, to the application of a cleaning agent to the surface using the fuser cleaner web and a metering channel with apertures.

Electrophotographic image-forming machines are used to transfer images onto paper or other medium in both printing and copier systems. Generally, a photoconductor is selectively charged and optically exposed to form an electrostatic latent image on the photoconductor surface. Toner is deposited onto the charged photoconductor surface. The toner has a charge; thus, it will adhere to the photoconductor surface in areas corresponding to the electrostatic latent image. The toner image is transferred to the paper or other medium. The toned paper is heated by any of several methods including a fuser roller system and the toner in image-wise configuration is fused to the paper.

The fuser roll used in the fuser roller system eventually becomes contaminated with debris containing toner or by-products of toner and paper. This contamination usually takes the form of a film which eventually builds up and adversely affects the release properties and overall print life of the fuser roll.

Various systems have been used to deliver release agent fluid to the fuser roll including ones that use oil soaked rolls and wicks with and without supply sumps as well as oil impregnated webs. The oil soaked rolls and wicks generally suffer from the difficulty in that they require a sump of oil to replenish the roll and the wick as its supply of release agent is depleted by transfer to the fuser roll. Furthermore, a wick suffers from the difficulty of a relatively short life due to accumulation and chemical interaction. The web systems, on the other hand are limited in the quantity of oil they can deliver since the web materials leak oil when saturated to high levels. The oil leaks are very undesirable and can decrease print quality because they can form oil blotches. Furthermore, excess oil which ends up on fused substrate (in the release agent film-splitting event in the fuser nip) can interfere with post finishing applications such as book-binding, Magnetic Ink Character Recognition (MICR) encoding, lamination, and the like. In the past, various treatments to the print as well as the utilization of different fuser oils minimized the issue.

For the reasons stated above, and for other reasons stated below which will become apparent to those skilled in the art upon reading and understanding the present specification, there is a need in the art for a fuser oil applicator and cleaner in a single web cartridge system. Furthermore, there is a need for an improved cleaning agent dispenser in a single web cartridge system.

SUMMARY

According to aspects of the embodiments, there is provided a cassette cleaning web having an agent metering tube that can apply oil via a drip pipe to a web as it enters a nip within the fusing surface. Dispensing the oil as it enters the nip increases the transportation and the holding capacity of the web. The cassette cleaning web can reduce the oil-on-copy to less than 3 mg/copy and more specifically to less than 1 mg/copy which would allow for adequate post finishing applications while still using amino functionalized fuser oil in the fuser subsystem. The cassette cleaning web reduces the contamination of the oil-sump because used web materials are wound up and oil or contaminate materials like wax, toner are retained in the spent web cartridge. This invention enables reduced oil-on-copy, eliminates the bulky and expensive release agent management system, and also provides a direct cleaning to the surface of the fuser roll.

DETAILED DESCRIPTION

Figure 1:
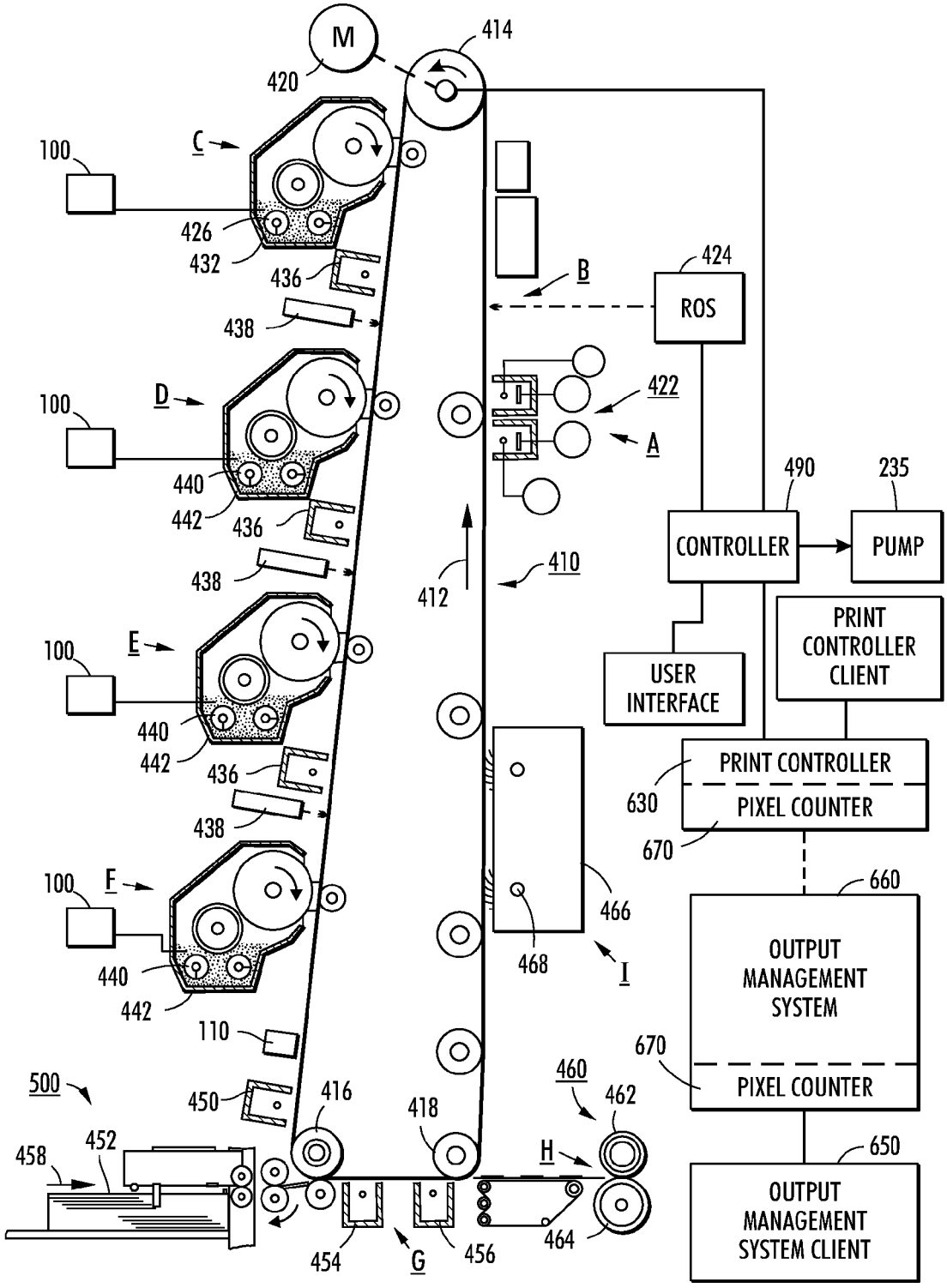
FIG. 1 illustrates a schematic view of an imaging apparatus in accordance to an embodiment.

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

Aspects of the disclosed embodiments relate to a fuser apparatus comprising a fuser roll; at least one web nip roll; a metering channel including a plurality of apertures, wherein each aperture is adapted to dispense by dripping a cleaning agent to a fuser cleaner web; and a fuser cleaner web disposed between the fuser roll and the web nip roll, wherein the fuser cleaner web cleans the fuser roll while supplying the cleaning agent to the fuser roll.

The disclosed embodiments further include a fuser apparatus wherein the plurality of apertures are aligned in a plane on the metering channel that faces away from the fuser cleaner web.

Still further, the disclosed embodiments may further include the fuser apparatus wherein the plurality of apertures are evenly spaced on the metering channel.

The disclosed embodiments further include a fuser apparatus wherein the cleaning agent flows around the outside of the metering channel and drops from the bottom of the metering channel onto the fuser cleaner web.

The disclosed embodiments further include a fuser apparatus wherein the cleaning agent is chosen from silicon oils and functionalized silicone oils.

The disclosed embodiments further include a fuser apparatus wherein the silicon oil is a polydimethylsiloxane (PDMS).

The disclosed embodiments further include a fuser apparatus wherein the functionalized silicon oils are chosen from amino-functionalized PDMS oils and mercapto-functionalized PDMS oils.

In another embodiment, a printing machine in which a print medium receives an electrostatic image comprising an electrostatic applicator for applying an image to a print medium;

a fuser roll mounted for rotation in the printing machine for applying heat to the print medium to bond said electrostatic image to the print medium; and apparatus to apply a cleaning agent to the fuser roll further comprising: a drive mechanism for rotating a supply reel with web material towards the fuser roll; a metering channel including a plurality of apertures, wherein each aperture is adapted to dispense by dripping a cleaning agent on the web material before it is extended across the fuser roll; a take-up reel positioned to receive the web material after it is extended across the fuser roll for engagement therewith; at least one application roller mounted for rotation between the supply reel and the take-up reel adjacent to the fuser roll, the application roller forming a nip with the fuser roll through which the web material extends, the nip applying the dispensed cleaning agent during engagement of the web material with the fuser roll.

Another embodiment may include a cleaning cartridge removably mountable to supply a cleaning agent to a surface of a fuser roller of a printing apparatus, the cleaning cartridge comprising: a cleaning agent metering tube with an inlet port and a plurality of outlet apertures arranged along its longitudinal extent, wherein each outlet aperture is adapted to dispense by dripping a cleaning agent to a web material; a drive mechanism for rotating a supply reel with web material towards the fuser roller; a take-up reel positioned to receive the web material after it is extended across the fuser roller for engagement therewith; at least one application roller mounted for rotation between the supply reel and the take-up reel adjacent to the fuser roller, the application roller forming a nip with the fuser roller through which the web material extends, the nip applying the dispensed cleaning agent during engagement of the web material with the fuser roll.

Still further, the disclosed embodiments may include the cleaning cartridge wherein the cleaning agent flows around the outside of the cleaning agent metering tube and drops from the bottom of the cleaning agent metering tube onto the web material.

The term "print media" or sheet generally refers to a usually flexible, sometimes curled, physical sheet of paper, plastic, or other suitable physical print media substrate for images, whether precut or web fed.

The term "printing system" as used herein refers to a digital copier or printer, xerographic printing machine, printing apparatus, bookmaking machine, facsimile machine, multifunction machine, or the like and can include several marking engines, as well as other print media processing units, such as paper feeders, finishers, and the like. The term "Print job" or "document" can include a plurality of digital pages or electronic pages to be rendered as one or more copies on a set of associated sheets of print media, each page, when rendered constituting the front or backside of a sheet. The pages of a print job may arrive from a common source and, when rendered, be assembled at a common output destination.

In as much as the art of electrophotographic printing is well known, the various processing stations employed in the FIG. 1 printing machine will be shown schematically and their operation described briefly with reference thereto. Various other printing machines could also be used, and this is only an example of a particular printing machine that may be used with the invention.

FIG. 1 is a partial schematic view of a digital imaging system, such as the digital imaging system of U.S. Pat. No. 6,505,832, which is hereby incorporated by reference. The imaging system is used to produce an image such as a color image output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of photoreceptor belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure which is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 200 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detach dicorotron 456 is provided for facilitating stripping of the sheets from the photoreceptor belt 410.

After transfer, the sheet of support material 452 continues to move, in the direction of arrow 458, onto a conveyor 600 which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and pressure roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator. The fuser assembly 460 may be contained within a cassette, and may include additional elements not shown in this figure, such as an endless fuser belt or endless fuser web (not the fuser cleaner web) around the fuser roller 462. In typical printing machines, this belt or web has been kept relatively short to minimize the size of the fuser assembly or cassette.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, and the like. The control of all of the exemplary systems heretofore described may be accomplished by conventional control switch inputs from the printing machine consoles selected by an operator. Conventional sheet path sensors or switches may be utilized to keep track of the position of the document and the copy sheets.

The foregoing description illustrates the general operation of an electrophotographic printing machine incorporating the fuser apparatus of the present disclosure therein. Not all of the elements discussed in conjunction with FIG. 1 are necessarily needed for effective use of the invention. Instead, these elements are described as a machine within which embodiments of the invention could operate.

Figure 2:
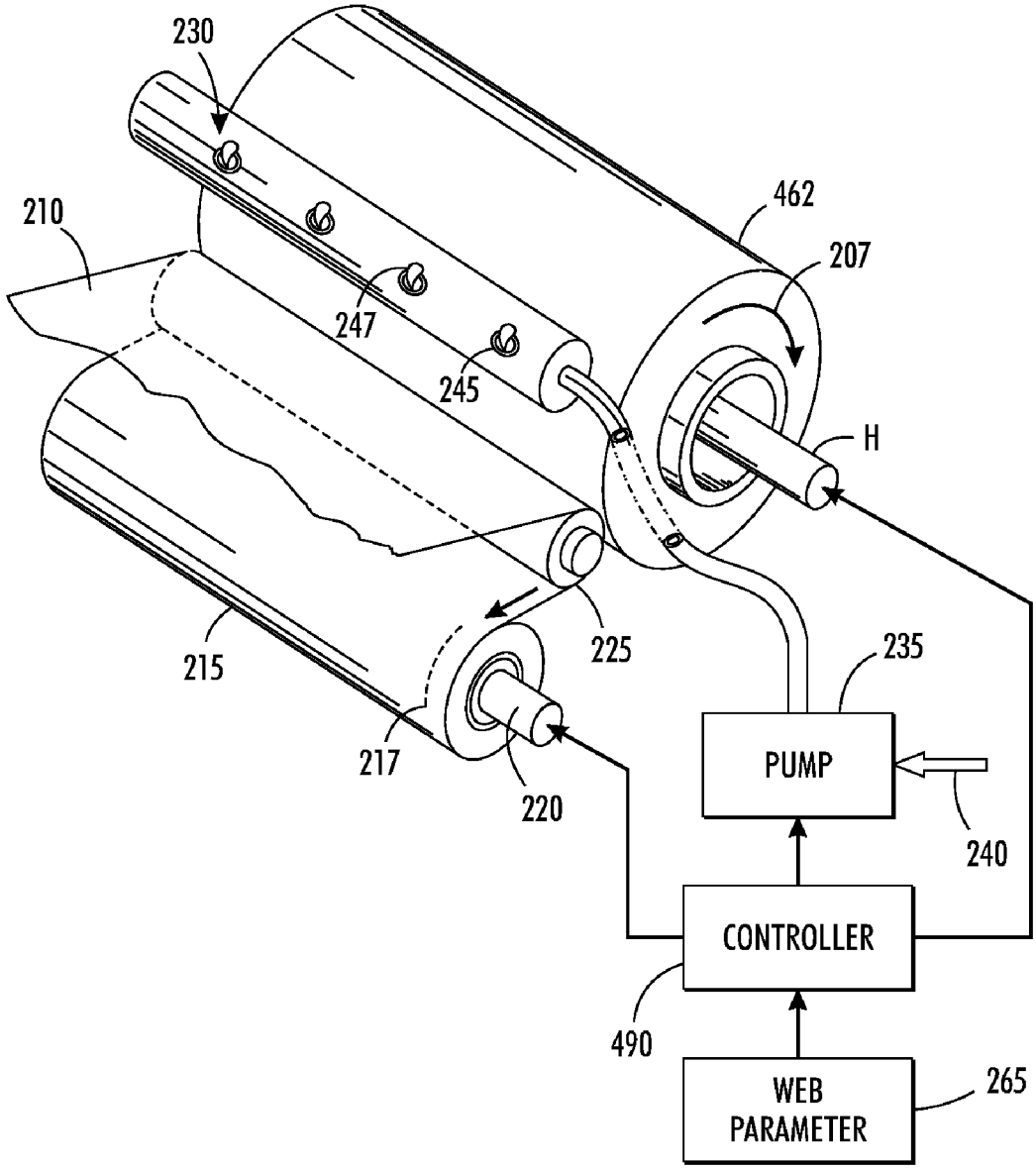
FIG. 2 is a schematic perspective view of a cleaning web with a metering channel including a plurality of apparatus for dispensing a cleaning agent on the cleaning web in accordance to an embodiment.

FIG. 2 illustrates the fuser assembly 460 in greater detail. The fuser roll 462 coming into contact with the toner image bearing surface of the copy sheet is internally provided with a heater (H) for supplying the thermal energy required for fusing the toner powder and fixing the same to the copy sheet. A pressure roller 225 rendered movable between a fixing position in which it is in pressure contact with the fuser roll 462 and a non-fixing position in which it is separated from the fuser roll 462. The fuser roll 462 driven in the direction of arrow 207 and the take-up roll 215 through shaft 220 are moved by a motor (not shown) under the control of controller 490. A web material 210 composed of a heat-resistant sheet material such as non-woven cloth is wound as a roll on a supply reel and is maintained in contact with the fuser roll 462 by a pressure roller 225 in the course of transport to the take-up roll 215. The web material absorbs any gelled oil, wax, toner, paper fiber and any other debris on the fuser roll 462. The contaminants are collected on the web material and will be moved out of the system when the take-up roll 215 is replaced. The idea of adding oil to a web as it is entering the nip with the fusing surface decreases waste and increases effective oil application. Thus more oil can be transported by the web than a typical pre-saturated web can support. The web configuration can be single or double nip and several locations of oil addition are possible in double nip set-ups like shown in FIG. 4 and FIG. 5. The benefits are that the web self-cleans as gelled oil, wax, toner, paper fiber and any other stuff will collect on the web and will be moved out of the system with the used web.

Figure 6:
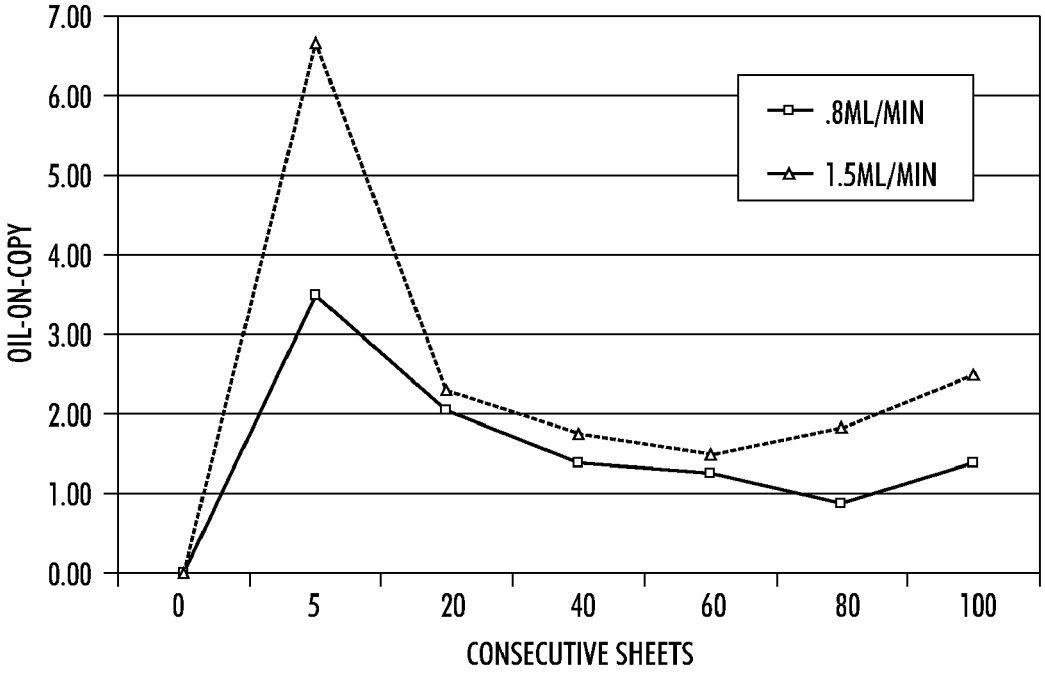
FIG. 6 illustrates oil-on-copy as a function of oil-drip speeds in accordance to an embodiment.

A metering channel, cleaning agent metering tube 230 adds a cleaning agent such as an oil to the web material 210 as it is entering or immediately prior to contact with the nip formed with the fusing surface. The metering channel 230 has an entering port for receiving a cleaning agent 240 from a pump 235 under the supervision of controller 490. The metering channel has a plurality of apertures 245, 247 that are aligned in a plane on the metering channel that faces away from the web material 210. The dripping rate is a function of the rate of cleaning agent that flow into the entering port and the dimensions and numbers of apertures at the metering channel. FIG. 6 shows the relationship of oil-on-copy for different drip rates. The cleaning agent 240 flows around the outside of the metering channel 230 and drops from the bottom of the metering channel 230 onto the web material 210.

The cleaning agent 240 is chosen from silicon oils such polydimethylsiloxane (PDMS) and functionalized silicone oils such as amino-functionalized PDMS oils and mercapto-functionalized PDMS oils. However, the cleaning agent 240 can comprise alcohol, butoxyethanol, 1-tert-butoxypropanol, propylene glycol ethers, propylene glycol co-polymers, ethylene oxide condensates (Merpol® kerosene, hexanes, heptanes, isobutylmethyl ketone, methylethyl ketone, and/or hydrogen peroxide, citric acid, acetic acid, linear siloxanes (hexamethyldisiloxane, octamethyltrisiloxane, or the like) and cyclic siloxanes (octamethyltetracyclosiloxane, decamethylpentacyclosiloxane, or the like), aminofucntional oligosiloxanes, poly(oxy-1,2-ethaediyl), alpha-(undecyl)-omega-hydroxy, to the region of the document along with water, a surfactant such sodium dodecylsulfate, dioctylsulfosuccinate, benzensulfonic acid, a polydimethylsiloxane (PDMS) based surfactant or fluorosurfactant. The amino-functional group release agents comprise at least one of: polydimethylsiloxane (PDMS), .alpha.-APS functional PDMS, and other functional fusing agents, as described, for example, in U.S. Pat. No. 6,743,561, the complete disclosure of which is incorporated herein by reference.

Web parameters 265 such as oil drop speed, and web material 210 speed, and other parameters such as attributes of the print media and the web material can be inputted into the controller 490 for optimal control of the dispensing/cleaning process.

Figure 3:
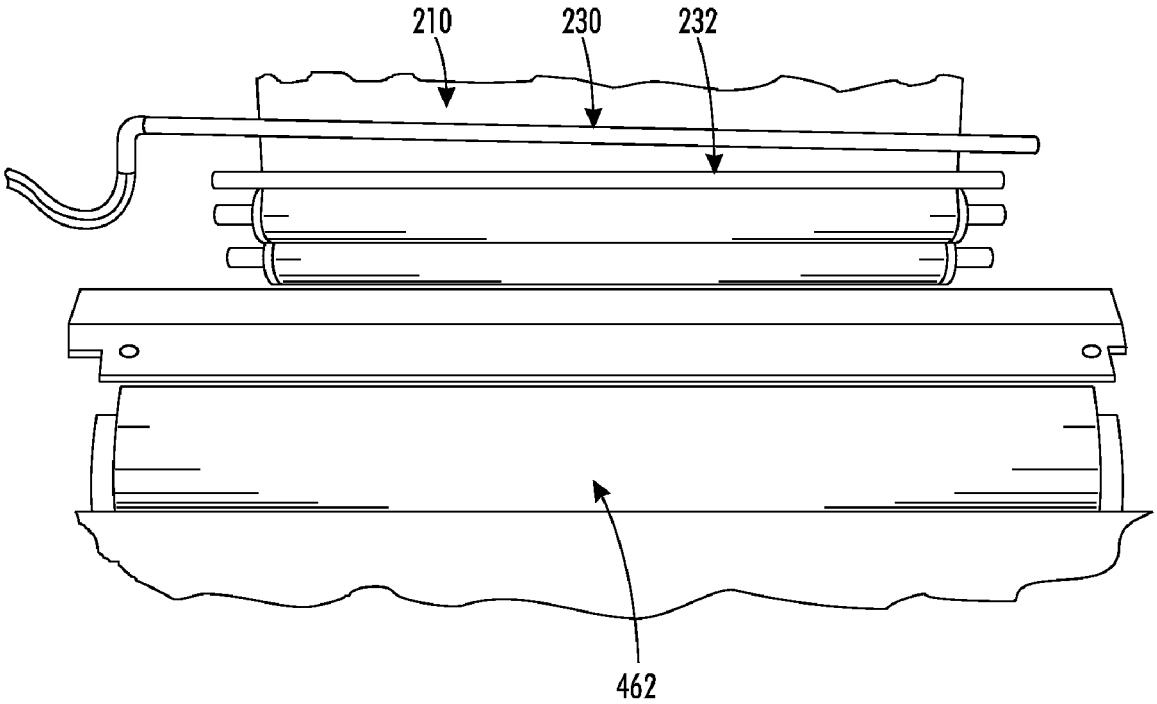
FIG. 3 is an illustration of the web cartridge and drip dispenser in accordance to an embodiment.

FIG. 3 is an illustration of the web cartridge and drip dispenser in accordance to an embodiment. A web material 210 is nipped against the fuser roll 462 such that PDMS fuser oil is dripped onto web by the metering channel 230. The shown metering channel 230 can be made from existing hollow copper tube (a DC8000 fuser component) with evenly spaced apertures or holes. The PDMS is used with a syringe pump to deliver the oil into the metering channel 230 positioned above the web material 210. The holes in the tube are at the top of the metering channel 230 and the ejected oil flows around the outside of the channel and drops from the bottom of the channel. The cleaning agent does not drop directly from the holes but after it diffuses on the lower skin of the channel. In the illustrated figure the oil drops onto the tension bar 232 of a tension bar mechanism to help with even spreading of the fuser oil, although the tension bar 232 could be placed in a variety of different locations closer or further from the nip.

Figure 4:
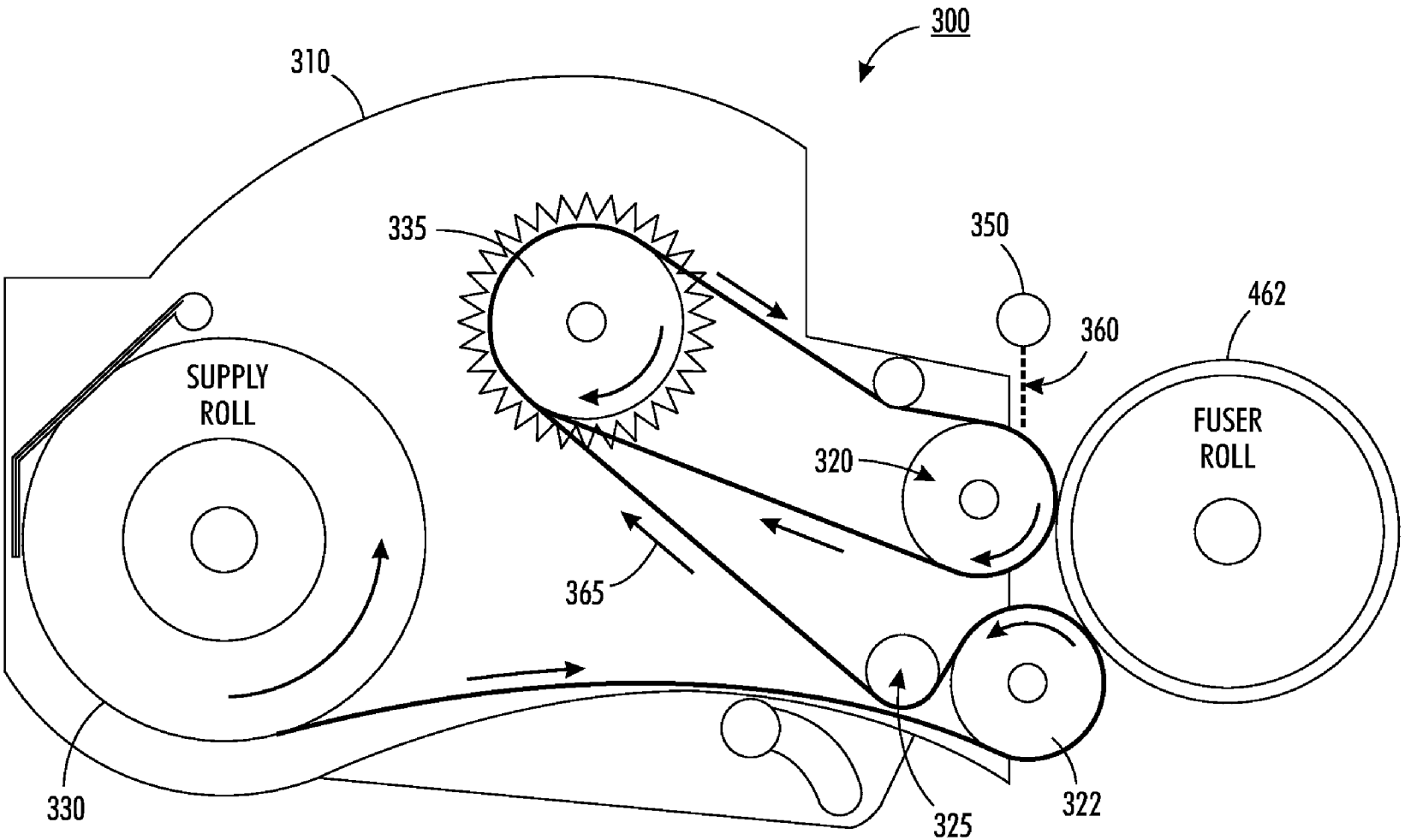
FIG. 4 is a side view of the web cartridge employing a one event oil exposure strategy in accordance to an embodiment.

FIG. 4 is a side view of the web cartridge employing a one event cleaning agent strategy 300 in accordance to an embodiment. The web cartridge 310 contains a supply roll 330 holds virgin web material 210 that is moved towards take-up roll through pressure roll 322 and pressure roll 320 until its is wound around take up roll 335. A motor (not shown) may drive the take up roll 335, causing the fuser cleaner web or web material 210 to move from the supply roll 330 in the direction of arrow 365, to come into contact with the fuser roll 462, and then to move in the direction of arrow onto the take up roll 335. A plurality of pressing rollers such as pressing roller 325 ensures that a controlled wrap exists between web material 210 and the pressure roller 322 and can in some instances be equipped with an encoder disc on its axis for use in measuring and for use in a feedback loop for a control system for controlling the velocity of the web material 210.

FIG. 4 illustrates a one event cleaning agent strategy where the agent is dispensed or dripped 360 by the metering channel 350 on the web material 210 when is at pressure roller 320 and immediately prior to contact with the fuser roll 462.

Figure 5:
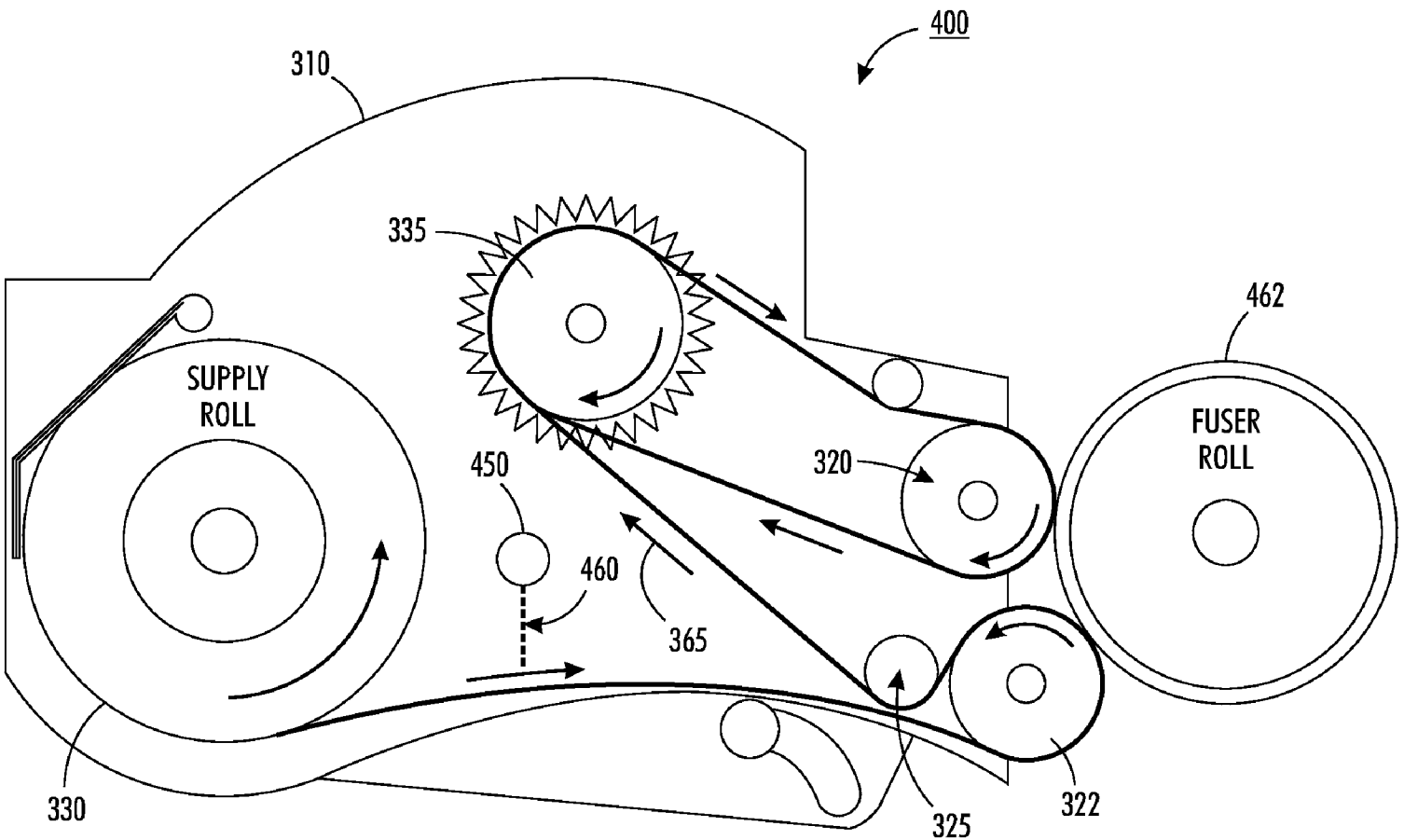
FIG. 5 is a side view of the web cartridge employing a two event oil exposure strategy in accordance to an embodiment.

FIG. 5 is a side view of the web cartridge employing a two event cleaning agent strategy 400 in accordance to an embodiment. The web cartridge 310 contains a supply roll 330 holds virgin web material 210 that is moved towards take-up roll through pressure roll 322 and pressure roll 320 until its is wound around take up roll 335. A motor (not shown) may drive the take up roll 335, causing the fuser cleaner web or web material 210 to move from the supply roll 330 in the direction of arrow 365, to come into contact with the fuser roll 462, and then to move in the direction of arrow onto the take up roll 335. A plurality of pressing rollers such as pressing roller 325 ensures that a controlled wrap exists between web material 210 and the pressure roller 322 and can in some instances be equipped with an encoder disc on its axis for use in measuring and for use in a feedback loop for a control system for controlling the velocity of the web material 210.

In the two event cleaning agent strategy the agent is dispensed or dripped 460 by the metering channel 450 on the web material 210 before pressure roller 322 and immediately prior to contact with the fuser roll 462. In this scenario the fuser roller 462 is exposed to the cleaning agent at two points as opposed to at one point with the one event strategy outlined above with reference with FIG. 4.

FIG. 6 illustrates oil-on-copy as a function of oil-drip speeds in accordance to an embodiment. Print runs up to 100 consecutive sheets at web speed of 1.4 mm/min using an oil drip rate of 0.8 mL/min and 1.5 mL/min were measured for oil-on-copy. The oil-on-copy metric captures the amount of oil on and in the substrate post-fusing. While there is some variability it is notable that the bulk of the samples at 0.8 mL/min rate were on the average less than 2 mg/copy and that when the oil drop rate was increased the amount of oil on the final substrate was also increased most being on the average between the range of 1-3 mg/copy. The metric for the 0.8 mL/Min is illustrated by function 610 and the 1.5 mL/Min by function 620.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The fuser oil applicator offers advantages to the convention pre-saturated web because it facilitates the removal of a complicated and expensive removal agent management (RAM) system with the replacement of a metering channel dispenser directly onto fuser roll. Further, the fuser oil applicator offers low amounts of oil transferred from fuser roll to substrate surface (around 0.5-3 mg/copy) to mitigate post-finishing issues such as excess fuser oil lingering on print surface. Further, since oil-recycling is not required there is no sump pump for contamination and since web materials are wound up and oil or contaminate materials such as wax and toner are retained in the spent web cartridge it provides a mechanism for easy removal and negates the need for complicated machinery. No streaking of oil was observed on print surfaces with oil on copy from 0.5-3 mg/8.5×11 (Letter) copy.

Although the illustrated embodiment relates to xerographic fusing, the invention can be used in other printing technologies, and the like. It is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A fuser apparatus, comprising:

a fuser roll;

at least one pressure roll;

a fuser cleaner web disposed between the fuser roll and the at least one pressure roll, wherein the fuser cleaner web makes contact with the fuser roll and cleans the fuser roll while supplying a release agent;

a tension bar mechanism to tension and release the fuser cleaner web disposed between the fuser roll and the at least one pressure roll; and a metering channel including a plurality of apertures, wherein each aperture is adapted to dispense by dripping a cleaning agent on the fuser cleaner web and the tension bar mechanism.

2. The fuser apparatus according to claim 1, wherein the plurality of apertures are aligned in a plane on the metering channel that faces away from the fuser cleaner web.

3. The fuser apparatus according to claim 2, wherein the plurality of apertures are evenly spaced on the metering channel.

4. The fuser apparatus according to claim 2, wherein the cleaning agent flows around the outside of the metering channel and drops from the bottom of the metering channel onto the fuser cleaner web.

5. The fuser apparatus according to claim 4, wherein the cleaning agent is chosen from silicon oils and functionalized silicone oils.

6. The fuser apparatus according to claim 5, wherein the silicon oil is a polydimethylsiloxane (PDMS).

7. The fuser apparatus according to claim 6, wherein the functionalized silicon oils are chosen from amino-functionalized PDMS oils and mercapto-functionalized PDMS oils.

8. A printing machine in which a print medium receives an electrostatic image comprising:

an electrostatic applicator for applying an image to a print medium;

a fuser roll mounted for rotation in the printing machine for applying heat to the print medium to bond said electrostatic image to the print medium;

apparatus to apply a cleaning agent to the fuser roll further comprising:

a drive mechanism for rotating a supply reel with web material towards the fuser roll;

a metering channel including a plurality of apertures, wherein each aperture is adapted to dispense by dripping a cleaning agent on the web material before it is extended across the fuser roll;

a take-up reel positioned to receive the web material after it is extended across the fuser roll for engagement therewith;

at least one pressure roll mounted for rotation between the supply reel and the take-up reel adjacent to the fuser roll, the at least one pressure roll forming a nip with the fuser roll through which the web material extends, the nip applying the dispensed cleaning agent during engagement of the web material with the fuser roll.

9. The printing machine according to claim 8, wherein the plurality of apertures are aligned in a plane on the metering channel that faces away from the web material.

10. The printing machine according to claim 9, wherein the plurality of apertures are evenly spaced on the metering channel.

11. The printing machine according to claim 9, wherein the cleaning agent flows around the outside of the metering channel and drops from the bottom of the metering channel onto the web material.

12. The printing machine according to claim 11, wherein the cleaning agent is chosen from silicon oils and functionalized silicone oils.

13. The printing machine according to claim 12, wherein the silicon oil is a polydimethylsiloxane (PDMS).

14. The printing machine according to claim 13, herein the functionalized silicon oils are chosen from amino-functionalized PDMS oils and mercapto-functionalized PDMS oils.

15. A cleaning cartridge removably mountable to supply a cleaning agent to a surface of a fuser roller of a printing apparatus, the cleaning cartridge comprising:

a cleaning agent metering tube with an inlet port and a plurality of outlet apertures arranged along its longitudinal extent, wherein each outlet aperture is adapted to dispense by dripping a cleaning agent to a web material;

a drive mechanism for rotating a supply reel with web material towards the fuser roller;

a take-up reel positioned to receive the web material after it is extended across the fuser roller for engagement therewith;

at least one pressure roll mounted for rotation between the supply reel and the take-up reel adjacent to the fuser roller, the at least one pressure roll forming a nip with the fuser roller through which the web material extends, the nip applying the dispensed cleaning agent during engagement of the web material with the fuser roll.

16. The cleaning cartridge according to claim 15, wherein the plurality of apertures are evenly spaced on the cleaning agent metering tube.

17. The cleaning cartridge according to claim 15, wherein the cleaning agent flows around the outside of the cleaning agent metering tube and drops from the bottom of the cleaning agent metering tube onto the web material.

18. The cleaning cartridge according to claim 17, wherein the cleaning agent is chosen from silicon oils and functionalized silicone oils.

19. The cleaning cartridge according to claim 18, wherein the silicon oil is a polydimethylsiloxane (PDMS).

20. The cleaning cartridge according to claim 19, herein the functionalized silicon oils are chosen from amino-functionalized PDMS oils and mercapto-functionalized PDMS oils.

* * * * *